US010178463B2

(12) United States Patent
Smiechowski

(10) Patent No.: US 10,178,463 B2
(45) Date of Patent: Jan. 8, 2019

(54) HEADPHONES

(71) Applicant: Apple Inc., Cupertino, CA (US)

(72) Inventor: Christina J. Smiechowski, West Hollywood, CA (US)

(73) Assignee: Apple Inc., Cupertino, CA (US)

( * ) Notice: Subject to any disclaimer, the term of this patent is extended or adjusted under 35 U.S.C. 154(b) by 5 days.

(21) Appl. No.: 15/247,797

(22) Filed: Aug. 25, 2016

(65) Prior Publication Data

US 2017/0257695 A1 Sep. 7, 2017

Related U.S. Application Data

(60) Provisional application No. 62/304,899, filed on Mar. 7, 2016.

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01)

(58) Field of Classification Search
CPC .... H04R 1/1066; H04R 1/105; H04R 1/1008; H04R 1/46; H04R 2460/13; H04R 25/606; H04R 2205/024; H04R 2201/103; H04R 2205/022; H04R 2420/07; F16D 63/008
See application file for complete search history.

(56) References Cited

U.S. PATENT DOCUMENTS

| | | | | |
|---|---|---|---|---|
| 3,467,229 | A * | 9/1969 | Deibel | F16D 51/22 188/245 |
| 4,727,585 | A * | 2/1988 | Flygstad | H04R 5/0335 2/209 |
| 5,793,878 | A * | 8/1998 | Chang | H04R 5/0335 381/370 |
| 8,861,770 | B2 * | 10/2014 | Blair | H04R 1/1058 381/378 |
| 2003/0210801 | A1 * | 11/2003 | Naksen | H04R 1/1066 381/370 |
| 2011/0051976 | A1 * | 3/2011 | Tsai | H04R 1/1066 381/378 |
| 2011/0119804 | A1 * | 5/2011 | Chiang | A61F 11/06 2/209 |
| 2014/0023222 | A1 * | 1/2014 | Ito | H04R 5/0335 381/379 |
| 2016/0177553 | A1 * | 6/2016 | Bosio | E03C 1/086 239/428.5 |

FOREIGN PATENT DOCUMENTS

| | | | | |
|---|---|---|---|---|
| JP | 63190942 | A * | 8/1988 | F16D 9/00 |

* cited by examiner

*Primary Examiner* — Oyesola C Ojo
(74) *Attorney, Agent, or Firm* — Kilpatrick Townsend & Stockton LLP

(57) ABSTRACT

A pair of headphones including an adjustable headphone band. The headphone band can include an inner member and an outer member. The headphones can further include a braking mechanism disposed between the inner member and the outer member, and an earcup attachment feature. In some embodiments, the braking mechanism can include a brake pad and a brake pad cover.

21 Claims, 9 Drawing Sheets

HEADPHONES

CROSS-REFERENCES TO RELATED APPLICATIONS

This application claims the benefit and priority under 35 U.S.C. 119(e) of U.S. Provisional Application No. 62/301,899 filed Mar. 7, 2016, entitled "HEADPHONES", the entire contents of which are incorporated herein by reference for all purposes.

FIELD

The present disclosure relates generally to headphones. More particularly, some embodiments relate to an adjustment feature of a headphone band.

BACKGROUND

Over-the-ear headphones are designed to be worn on a listener's head and such headphones typically include a headphone band that extends between two earcups within which are positioned speakers. For optimum performance, the headphones are typically worn such that the earcups cover a listener's ears.

In many over-the-ear headphones the headphone band is adjustable allowing the headphones to securely fit heads of various shapes and sizes. Some adjustable headphone bands include a ratcheting mechanism with discrete locking positions. When a listener wears the headphone on their head and adjusts the length, extra pressure on the headphone band can cause the headphone to 'bind' the ratcheting system thereby making adjustment difficult.

SUMMARY

Embodiments of the disclosure pertain to a brake mechanism that can be used in an adjustable headphone band and to a pair of headphones that includes such a brake mechanism. As the headphone band is adjusted in length (extended or retracted), the brake mechanism can tend to secure the headphone band at the adjusted length. Embodiments of the disclosure enable the length of the headphone band to be smoothly adjusted to better accommodate listeners having different sized heads while minimizing binding of the adjustment mechanism and thus providing an improved user experience.

In some embodiments, the brake mechanism includes a brake pad and a brake pad cover. The brake pad can be compressible and lodged within an interior channel of a headphone band formed between an inner member and an outer member of the band. The brake pad can pass through an aperture in an earcup attachment feature which can be extended or retracted by a listener. The brake mechanism travels with the earcup attachment feature in the interior channel as the length of headphone band is adjusted.

Because of friction with the inner member and friction with the outer member, the brake mechanism resists movement of the earcup feature along the interior channel. Because the brake pad is typically compressible, it can maintain contact with the inner member and the outer member as the width of the interior channel varies.

In some embodiments, the inner member can be made by methods that include double shot insert molding. In such methods inserts can be formed first and then a plastic such as silicone can be injected through a mold where the inserts are assembled and heated. This can lead to an inner member that is seamless on a cosmetic surface of the carrier. In some embodiments, the earcup attachment feature can be made by a process including three-dimensional stamping.

Some embodiments are directed to a pair of headphones, including a headphone band having an outer member and an inner member cooperating to define an interior channel. The headphones can further include an earcup and an earcup attachment feature having a first end coupled to the earcup and a second end having an aperture formed therethrough and disposed within the interior channel. The headphones can further include a brake mechanism extending through the aperture and compressed between the inner member and the outer member.

In some embodiments, the brake mechanism resists movement of the earcup attachment feature along the interior channel by generating friction with both the inner member and the outer member of the headphone band. In some embodiments, the brake mechanism can generate more friction with outer member than with the inner member.

In some embodiments, the brake mechanism can include a compressible brake pad and brake pad cover. In some embodiments, a coefficient of friction between the brake pad and the outer member is greater than a coefficient of friction between the brake pad cover and the inner member. In some embodiments, the brake pad cover can be self-lubricating and can be made of a self-lubricating material such as polyoxymethylene (POM). In some embodiments, the brake pad can include silicone.

In some embodiments, the brake pad cover includes a ridge area that defines a pocket. In such embodiments, the brake pad can be positioned within the pocket.

In some embodiments, the brake pad cover can have a curved bottom surface. In some embodiments, the earcup attachment feature can further include a leg that extends between the first end and the second end. In examples, the earcup attachment feature can be lesser than 5 mm thick.

In some embodiments, the earcup attachment feature can be a first earcup attachment feature, and the headphones can further include a second earcup attachment feature disposed at a second end of the headphone band.

In some embodiments, the interior channel can a variable thickness and the brake mechanism can include a compressible block of material that expands or contracts to maintain friction along the length of the interior channel.

In some embodiments, the earcup attachment feature can be formed using a progressive die. The inner member can be formed using a double shot insert molding process.

DETAILED DESCRIPTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Some embodiments of the disclosure pertain to over-the-ear headphones and to various methods of forming such headphones. Some embodiments also pertain to a brake mechanism that can be used in an adjustable headphone band that enables the headband to be adjusted to accommodate different sized heads of listeners in a smooth and user-friendly manner. As the headphone band is adjusted in length (extended or retracted), the brake mechanism can tend to secure the headphone band at the adjusted length.

In some embodiments, the brake mechanism includes a brake pad and a coupled brake pad cover. The brake pad can be compressible and lodged between an inner member and an outer member of the headphone band. The brake pad can pass through an aperture in an earcup attachment feature which can be extended or retracted by a listener. The brake mechanism travels with the earcup attachment feature in an interior channel between the inner member and the outer member.

Because of friction with the inner member and friction with the outer member, the brake mechanism resists movement of the earcup feature farther into and out of the interior channel between the inner member and the outer member. Because the brake pad can be compressible, it can adjust to varying width of the interior channel.

Other aspects and advantages of the disclosure will become apparent from the following detailed description taken in conjunction with the accompanying drawings which illustrate, by way of example, the principles of the described embodiments.

Figure 1:
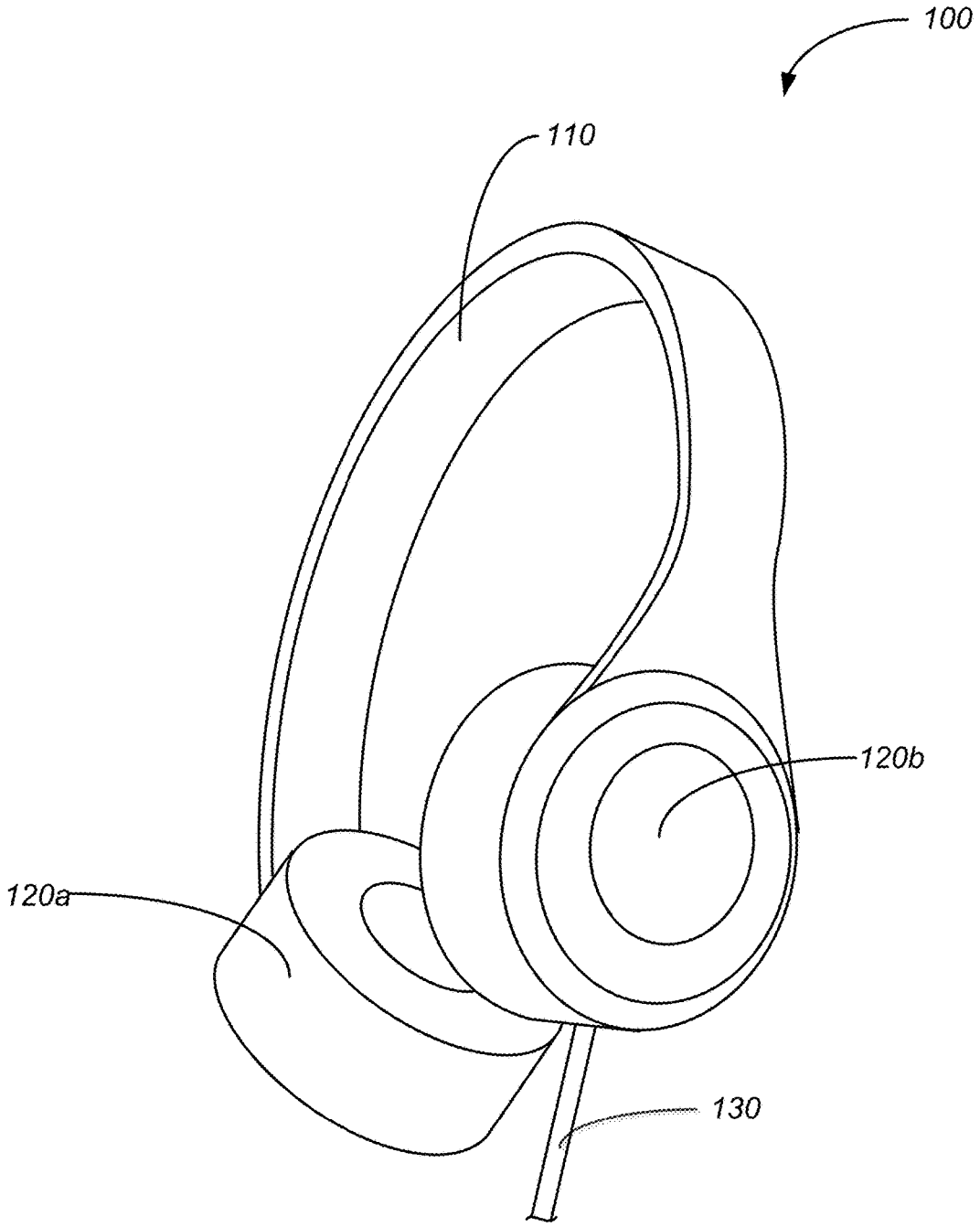
FIG. 1 is a simplified illustration of a pair of headphones according to an embodiment of the disclosure.

FIG. 1 is a simplified illustration of a pair of headphones 100 according to an embodiment of the disclosure. As shown in FIG. 1, pair of headphones 100 can include a headphone band 110, first and second earcups 120*a* and 120*b*, and an audio input wire 130. In some examples, audio input can be received wirelessly, such as through a Bluetooth™ network or AM/FM radio in which case audio input wire 130 is optional. Although not apparent in FIG. 1, each earcup 120*a* and 120*b* can include speakers for audio output. Earcups 120*a* and 120*b* can also include various components such speaker magnets, an acoustic mesh, a rotation foam, a balancer, an ear cushion, an ear cushion bracket a sealing foam, a baffle, and a strain relief feature.

Headphone band 110 can include various components that are not shown in FIG. 1. For example, headphone band 110 can include an electrical connection to each earcup 120*a* and 120*b* to transmit audio signals to the earcups. Headphone band 110 typically forms an arch shape and can be worn over a listener's head holding each of earcups 120*a* and 120*b* in place. For optimum performance, earcups 120*a* and 120*b* are worn over a listener's ear so as to fully or at least partially cover each ear. In some embodiments, headphones 100 can also include a noise cancellation feature. The noise cancellation feature can be substantially improved if a listener's ears are completely covered by the earcups.

According to embodiments of the disclosure, the length of headphone band 110 can be adjusted to accommodate different sized heads of different listeners. For example, a listener can place the headphone band over his or her head and then adjust its length such that the earcups are positioned directly over each of the listener's ears. During the process, earcups 120*a* and 120*b* can be pulled apart, thereby changing the curvature of headphone band 110 before its length is adjusted. In some examples, the length adjustment mechanism can include a ratcheted leaf spring system. While using such a ratcheted leaf spring system not designed in accordance with the present disclosure, pulling the earcups apart before attempting to change the length of the headphone band can cause the headphones to 'bind'. In other words, changing the length of the headphone band can be difficult or inconvenient while using a leaf spring system.

According to embodiments, the length adjustment mechanism can include a brake mechanism as described in detail below that reduces the likelihood of "binding" when the length of the headband is adjusted and thus provides the listener with an improved user experience while adjusting the length of the headphone band. Unlike a ratcheted leaf spring system not designed in accordance with the present disclosure which has discrete adjustment levels, embodiments in accordance with the present disclosure can provide for continuous adjustment.

Figure 2:
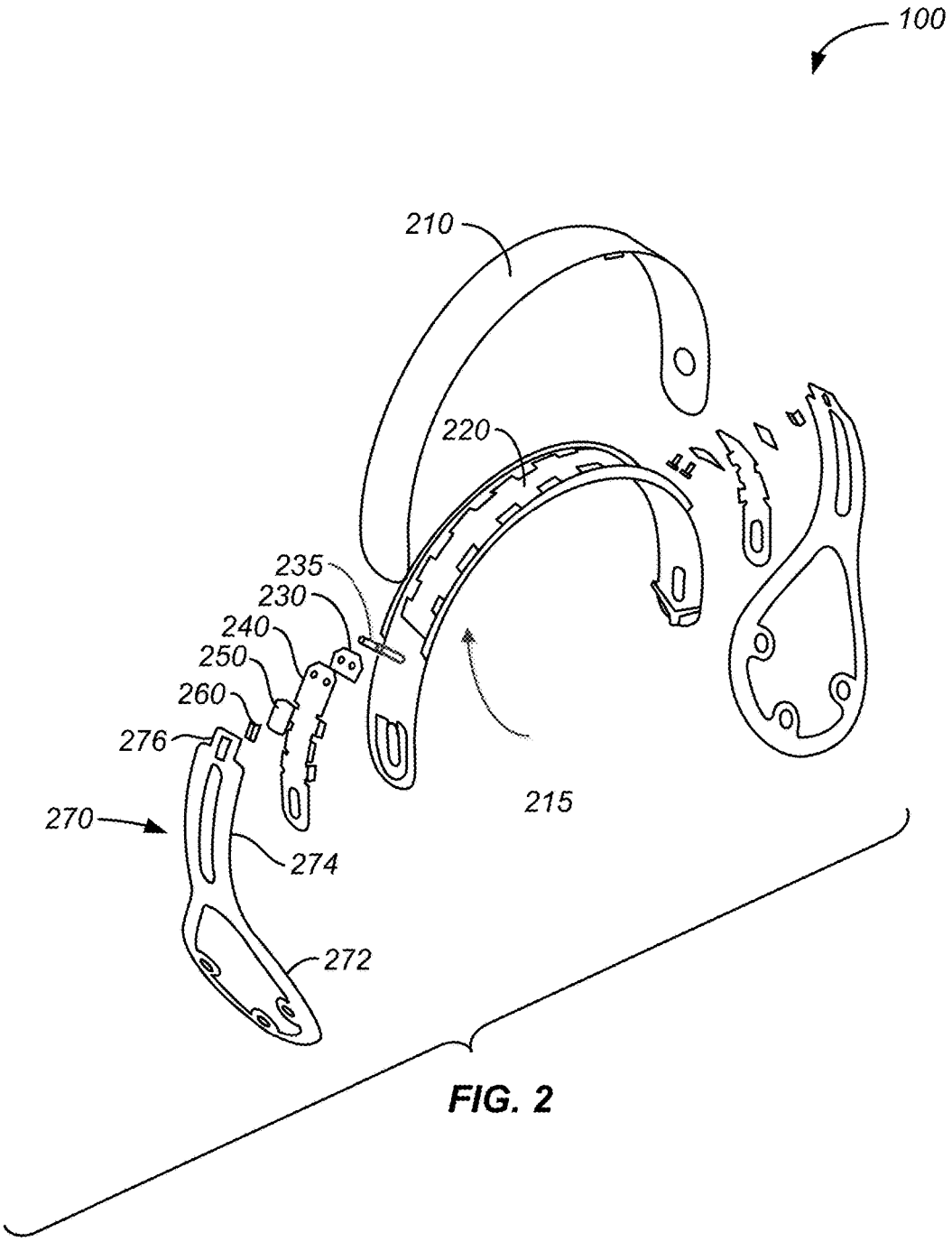
FIG. 2 is an exploded view of some components of the pair of headphones shown in FIG. 1.

FIG. 2 illustrates an exploded view of some of the components of headphones 100 according to some embodiments of the disclosure. It is to be noted that headphones 100 can include many other components that are not shown in FIG. 2. FIG. 2 also includes components that form a brake mechanism according to embodiments.

As shown in FIG. 2, pair of headphones 100 can include a headphone band that includes at least an outer member 210 and an inner member 215 that includes a carrier 220. Each of outer member 210 and the inner member 215 can have an arch shape that, when in a relaxed state, is generally symmetrical between the left and right halves of the headphone band. It is to be noted that the 'outer' member and 'inner' member need not necessarily be the outermost or inner most components of headphone band 110. Relationally, outer member 210 is located radially outward from the inner member. For example, the headphone band can have exterior surfaces formed by one or more a cosmetic layers adhered to either or both of outer member 210 and the inner member. Additionally, a pad or other type of cushioned layer may be part of the headphone band and adhered to either or both of outer member 210 and inner member 215.

In some embodiments, inner member 215 can further include a support 240 that can be attached to carrier 220 by a screw mount 230 and screws 235. Support 240 can provide a surface for brake mechanism 315 described below to slide along as described below. In other embodiments, support 240 is optional and inner member 215 can be designed to all the brake mechanism to slide directly along a portion of its interior surface.

Each of the outer and inner members 210 and 220 can be made from a variety of different materials. For example, in some embodiments, outer member 210 can be made from a thermoplastic material that is durable and flexible, such as TR90. In some embodiments, carrier 220 can be made from a plastic and insert molded silicone. Methods of forming carrier 220 according to some embodiments are described further below.

Outer member 210 and inner member 215, when assembled, can form an interior channel (not shown in FIG. 2) therebetween. In some embodiments, the curvature of the outer member and the curvature of the inner member can vary slightly, thereby varying the width of the interior channel from the ends of the headphone band to the middle of the headphone band.

Pair of headphones 100 can further include a brake mechanism. As shown in FIG. 2, the brake mechanism can include a brake pad 260 and a brake pad cover 250. The brake mechanism can travel in the interior channel formed between the inner member and the outer member as explained in detail with reference to FIGS. 3-5. In some embodiments, brake pad 260 can be made using silicone and brake pad cover 250 can be made using a self-lubricating plastic such as POM.

As shown in FIG. 2, pair of headphones 100 can also include an earcup attachment feature 270 for each of the left and right earcups. Earcup attachment feature 270 can have a three-dimensional shape and can include a first end 272 coupled to an earcup, a second end 276 coupled to the brake mechanism, and a leg 274 that extends between the first end and the second end. Earcup attachment feature 270 can be made from a variety of different materials and in some embodiments, earcup attachment feature 270 can be made from steel. Earcup attachment can be relatively thin in relation to its height and width. For example, in some embodiments, earcup attachment feature 270 is lesser than 3 mm thick. Example methods for making earcup attachment feature 270 are provided below with reference to FIG. 8.

Figure 3:
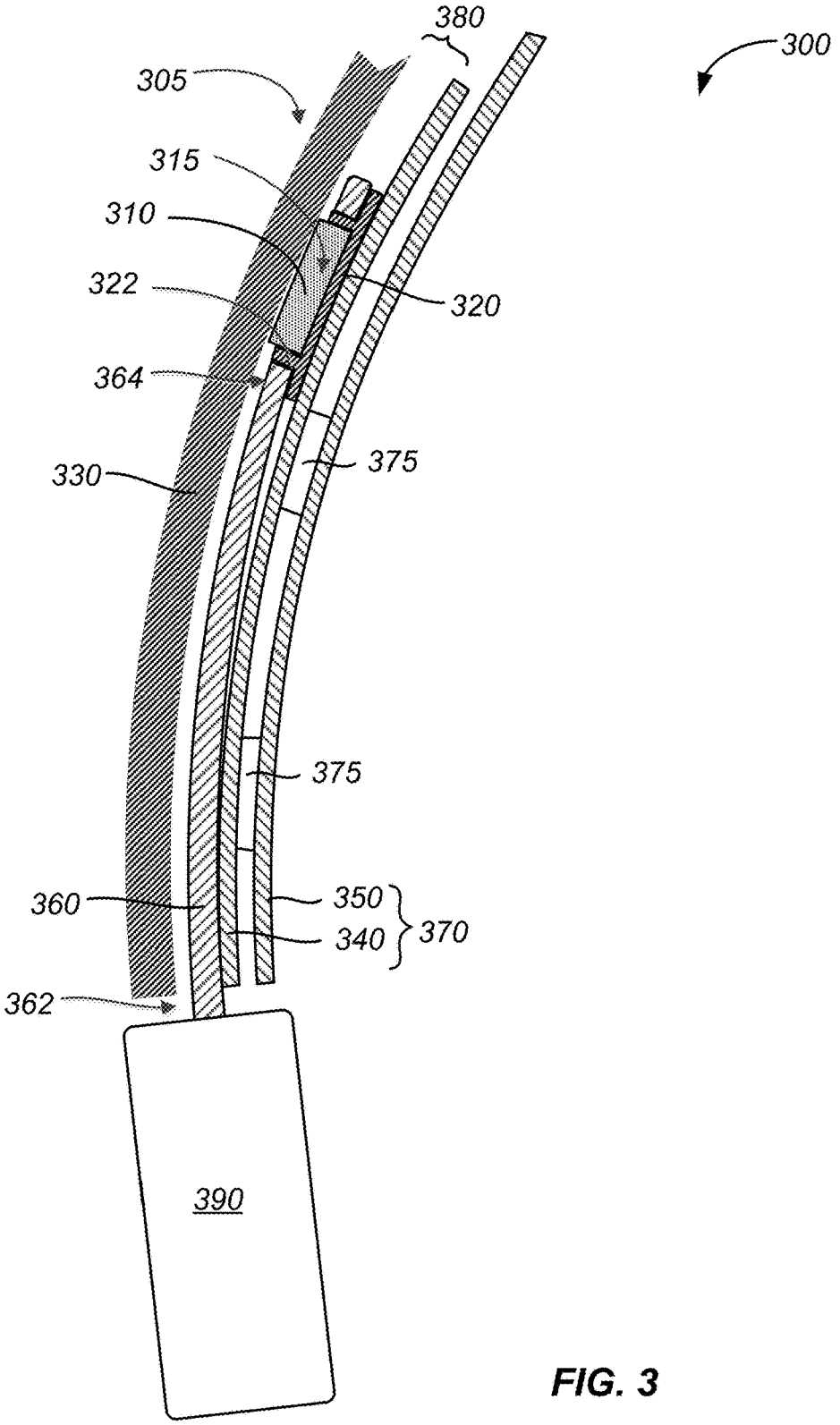
FIG. 3 is simplified cross-sectional view of a headphone band having a brake mechanism, according to some embodiments of the disclosure.

FIG. 3 is simplified cross-sectional view of a portion of a pair of headphones 300 taken through a center of the length of its headphone band 305. Also shown in FIG. 3 is a brake mechanism 315 according to some embodiments of the disclosure. Headphones 300 can include a similar mirrored assembly as shown in FIG. 3 on the opposite side of the headphones.

FIG. 3 depicts a portion of headphone band 305 in a relaxed state forming an arch. As shown, an outer member 330 and an inner member 370 cooperate to form an interior channel 380. The width of interior channel 380 can vary, intentionally or unintentionally, across the length of the headphone band. Inner member 370 can further include a support 340 and a carrier 350. Support 340 can be attached to an outer surface of carrier 350 using inserts 375. Support 340 can be attached to a silicone surface of carrier 350 at both ends of carrier 350. In some embodiments, support 340 can be used to fit into a previous-generation in carrier 350 made to operate with a ratcheting leaf spring system.

Outer member 330 and inner member 370 can be relatively thin compared to their length. The width of outer member 330 and inner member 370 can be of the order of the width of the headphone band. In some embodiments, outer member 330 can be made substantially of plastic. In some embodiments, support 340 can be made substantially of a metal or metal alloy. In examples, support 340 can be made using stainless steel.

As shown in FIG. 3, brake mechanism 315 can include a brake pad 310 and a brake pad cover 320. Brake pad 310 can be disposed within a pocket of brake pad cover 320. In some embodiments, brake pad cover 320 can be lubricated. For example, brake pad cover 320 can include a self-lubricating material such as polyoxymethylene (POM). The lubrication between a bottom surface of brake pad cover 320 and a top surface of support 340 can allow the brake mechanism to travel along interior channel 380. A top surface of brake pad 310 can be in contact with a bottom surface of outer member 330 thereby creating friction between the surfaces. In some embodiments, brake mechanism 315 can be lodged between outer member 330 and inner member 370 and in contact with both outer member 330 and inner member 370.

As shown in FIG. 3, brake mechanism 315 can extend through an aperture in an earcup attachment feature 360. More specifically, earcup attachment feature 360 can be attached to earcup 390 at a first end 362, and have an aperture formed in a second end 364. Outer walls 322 of the brake pad cover can be in touch with the inner surface of the aperture.

During use, earcup 390 can be pulled apart and away from the other earcup (not shown) so as to increase the radius of the arch formed by headphone band 305. In this open position, earcup attachment feature 360 can be extended outward to increase the length of the headphone band, for example to ensure that earcups 390 are positioned directly over a listener's ears. As headphone band 305 is extended or retracted, earcup attachment feature 360 slides within interior channel 380. Since brake mechanism 310 is attached to earcup attachment feature 360, the brake mechanism travels along interior channel 380 along with earcup attachment feature 360. As brake mechanism 315 travels within channel 380, friction between brake pad 310 and outer member 330 is generated as is friction between brake cover 320 and inner member 370.

The generated friction resists or restricts the movement of earcup attachment feature 360 along interior channel 380, thereby helping to hold the headphone band in position after length adjustments have been made. In some embodiments, the resistance provided by the brake mechanism can be set by selecting appropriate materials and sizes of brake pad 310 and brake pad cover 320 such that earcup attachment feature 360 can hold any position that it is adjusted to in the absence of external forces as earcup attachment feature 360 is extended or retracted to adjust its position by the user.

In some embodiments brake pad 310 can be compressible. In some embodiments, the thickness of the brake mechanism can be greater than the thickness of interior channel 380 along the entire channel causing the brake pad to always have some amount of compression. In some embodiments, due to the unintended varying dimensions of channel 380, brake pad 310 can be in potentially varying degrees of compression. In some embodiments, brake pad 310 can be made of a material that provides a similar level of response force for a range of compressions. Because of such a property, brake pad 310 can help the brake mechanism provide a relatively constant brake action while in all positions along the headphone band. In some embodiments, brake pad 310 can be made substantially of silicone and in some embodiments, brake pad cover 320 can be self-lubricating and made substantially of POM. In some embodiments, the coefficient of friction between brake pad 310 and outer member 330 is greater than the coefficient of friction between brake pad cover 320 and support 340 of inner member 370.

In embodiments such as depicted in FIG. 3, forces operating when earcup 390 is pulled apart from the other earcup (not shown) are separated out from forces operating to adjust the length of headphone band 305. Hence, holding the headphones 'open' while adjusting the length of the headphone band need not necessarily make the adjustment constricted. In other words, the force used to pull the earcups apart does not press the brake mechanism into the inner member much. In other adjustment mechanisms such as ratcheted system with leaf springs, holding the headphones open can cause binding thereby making adjustment more difficult. Under the current disclosure, the surface contact likely to bind when worn, i.e. the contact between the lower surface of brake pad cover 310 and the outer surface of inner member 370 is lubricated, thereby minimizing binding.

Figure 4A:
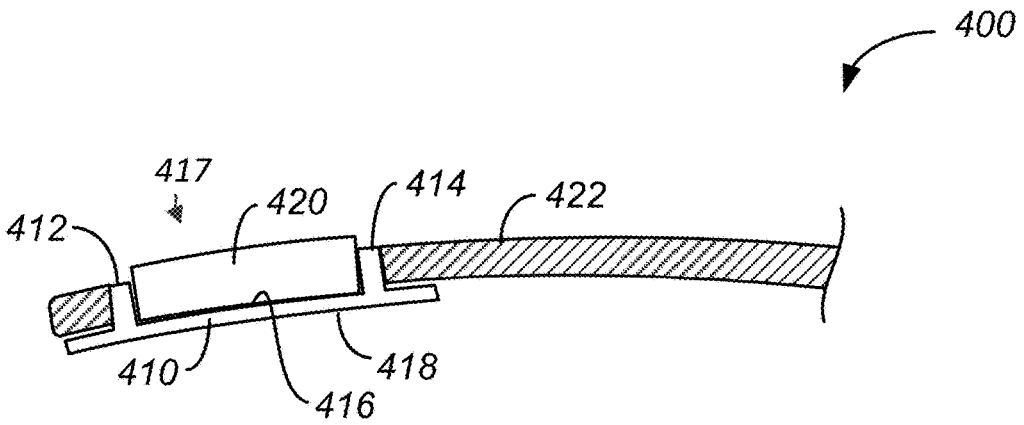
FIG. 4A is cross-sectional illustration of an example brake mechanism that can be incorporated into the headphone band shown in FIG. 3 according to some embodiments of the disclosure.

FIG. 4A is cross sectional illustration of a brake mechanism 400 according to embodiments of the disclosure. As shown in FIG. 4A, brake mechanism 400 includes brake pad 420 and brake pad cover 410. Also shown in FIG. 4A is one end of an earcup connection feature 422 having an aperture through which brake mechanism 400 is shown extending through. In some embodiments, such as illustrated in FIG. 4A, a lower surface 416 of brake pad 420 can be in contact with an upper surface of brake pad cover 410.

Brake pad cover 410 includes first and second ridges 412 and 414 that define a pocket in which brake pad 420 is positioned within. In some embodiments, brake pad cover 410 can form a single ridge area that surrounds a perimeter of a pocket in which brake pad 420 is disposed.

As shown in FIG. 4, in some embodiments, ridges 412 and 414 of brake pad cover 410 can be in contact with an inner surface of an aperture 417 formed through earcup connection feature 422. In some embodiments, brake pad cover 410 is adhesively attached to the inner surface of earcup connection feature 422 while in other embodiments brake pad cover 410 can be press-fit or otherwise positioned within the aperture.

In some embodiments, a bottom surface 418 of brake pad cover 410 can be curved to match, or partially match, the curvature of the support (not shown in FIG. 4A), which forms a part of the inner member that brake pad cover 410 slides along.

Figure 4B:
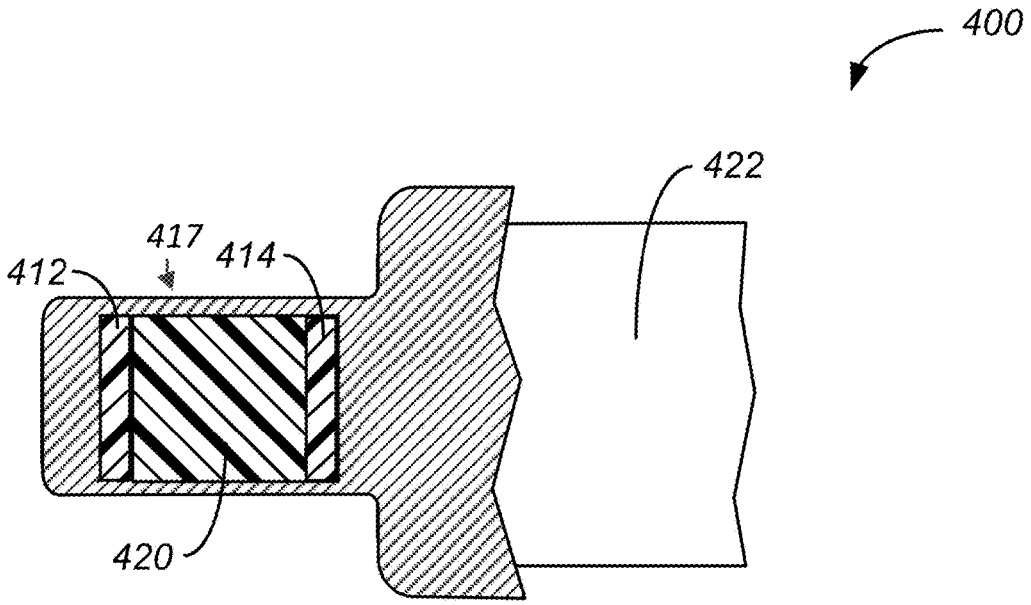
FIG. 4B is a top view of the brake mechanism shown in FIG. 4A.

FIG. 4B is a top view of brake mechanism 400. As shown in FIG. 4B, brake pad 420 is positioned within aperture 417 and between ridges 412 and 414.

Figure 5A:
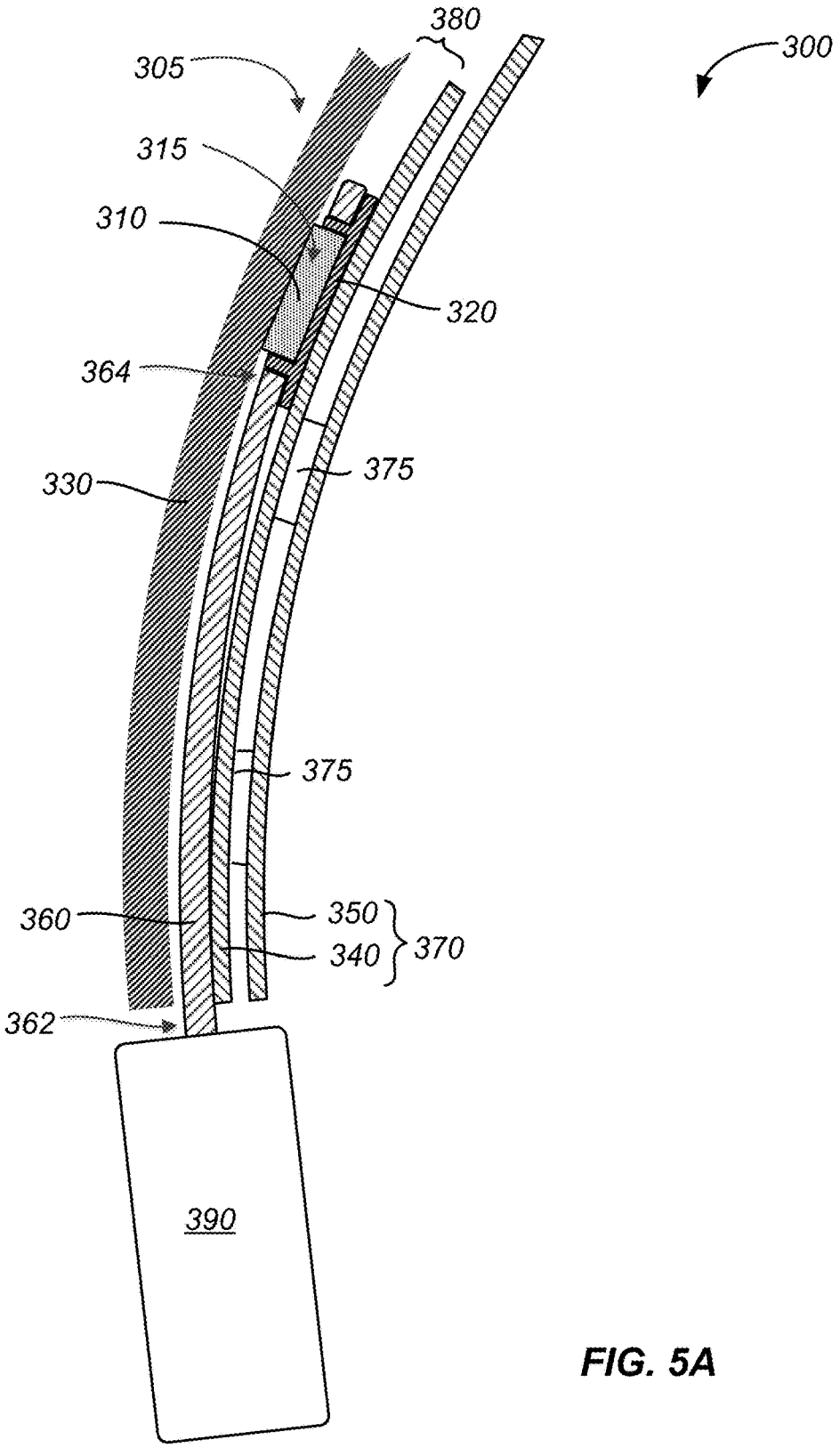
FIG. 5A is a simplified cross-sectional view of a portion of a headphone band depicting a brake mechanism with the earcup connection feature fully retracted according to some embodiments of the disclosure.
Figure 5B:
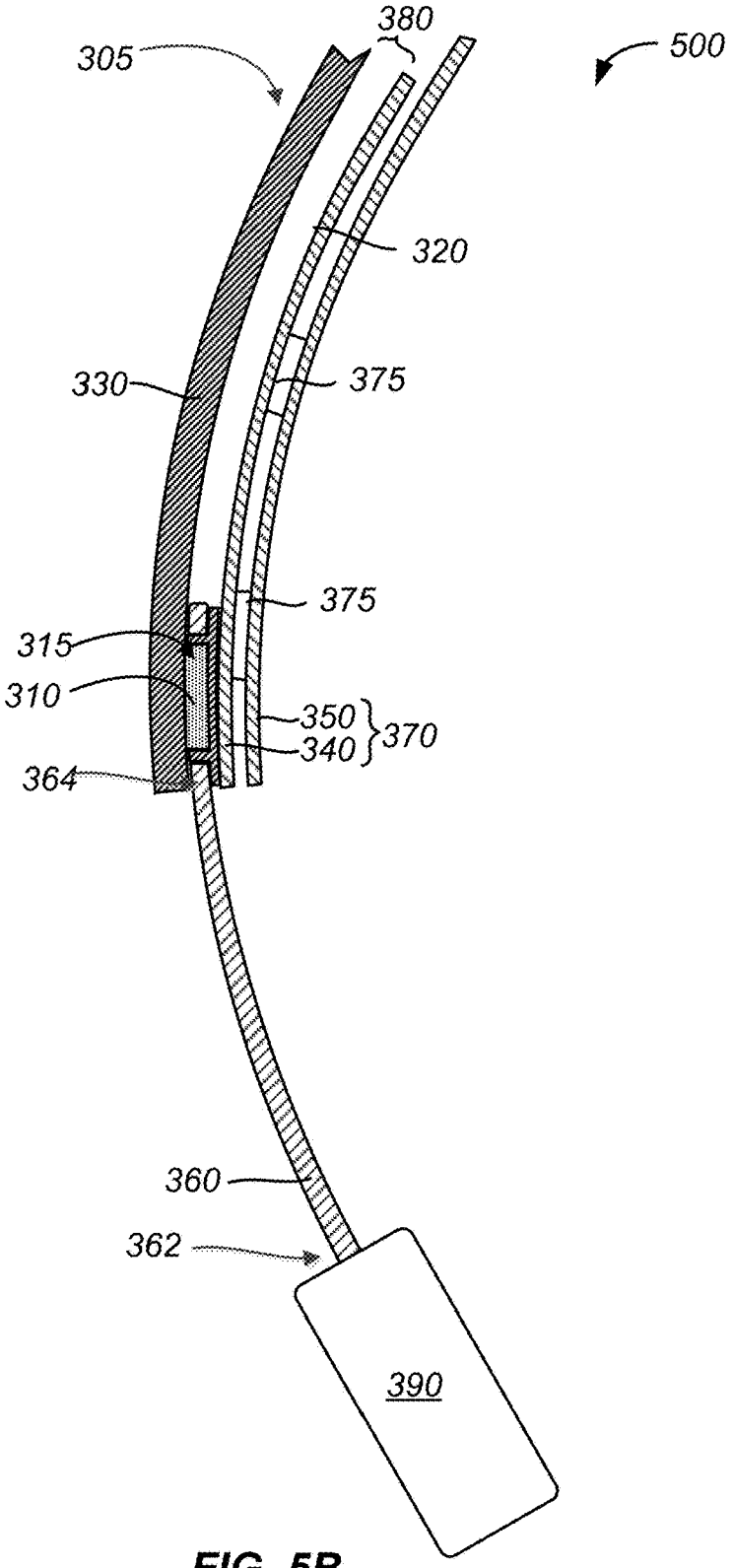
FIG. 5B is a simplified cross-sectional view of the headphone band shown in FIG. 5A showing the brake mechanism when the earcup connection feature is fully extended according to some embodiments of the disclosure.

FIGS. 5A and 5B are simplified cross sections taken through a headphone band along its middle showing brake assembly 300 when the earcup connection feature is fully retracted (FIG. 5A) and fully extended (FIG. 5B), according to embodiments. In FIG. 5A, the headphone band has been adjusted to shorten its length to the allowable extent by retracting earphone attachment feature 360. In some embodiments, in a retracted position, brake mechanism 315 can be positioned close to an area of attachment between outer member 330 and inner member 370. At such a position, brake pad 310 can be more compressed than in a position away from areas of attachment between outer member 330 and inner member 370.

In FIG. 5B, the headphone band has been adjusted to lengthen it to the allowable extent by extending earphone attachment feature 360. In such an extended position, in some embodiments, brake mechanism 315 can again be positioned close to an area of attachment between outer member 330 and inner member 370. At such a position, brake pad 310 can be more compressed than in a position away from areas of attachment between outer member 330 and inner member 370. At the areas of attachment between outer member 330 and inner member 370 (fastening locations), the width of interior channel 380 can be controlled. Between the fastening locations, materials of headphone band 305 can flex, leading to an increase in the width of the interior channel. The compression of brake pad 310 can vary along interior channel 380 to accommodate for differences in width.

Turning now to other components that form part of headphones 100 as shown in FIG. 2, methods of making carrier 350 and earcup attachment feature 360 are described further below, according to embodiments.

Figure 6A:
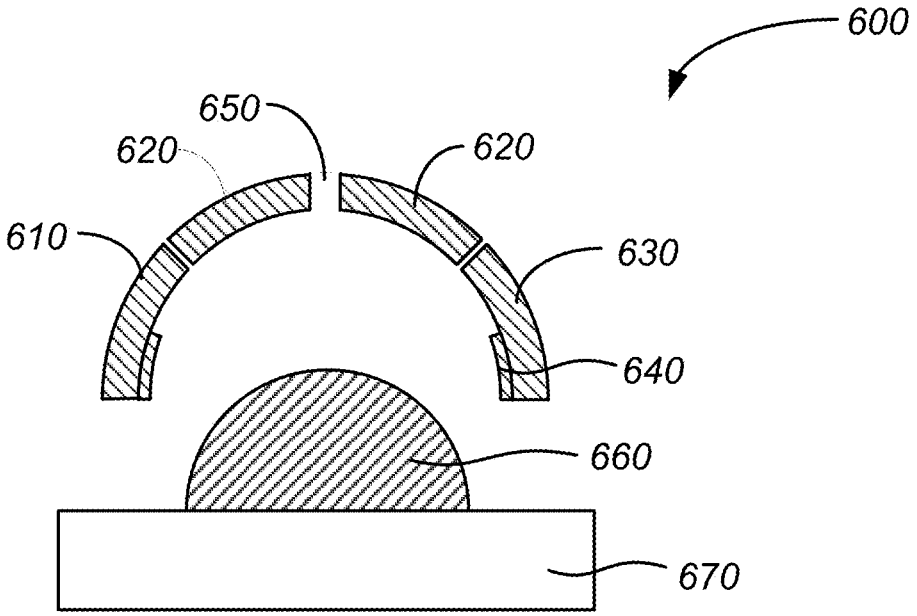
FIGS. 6A and 6B are simplified illustrations of a double shot insert molding process that can be used to form a carrier of the headphone band when the mold is open and closed, respectively, according to some embodiments of the disclosure.
Figure 6B:
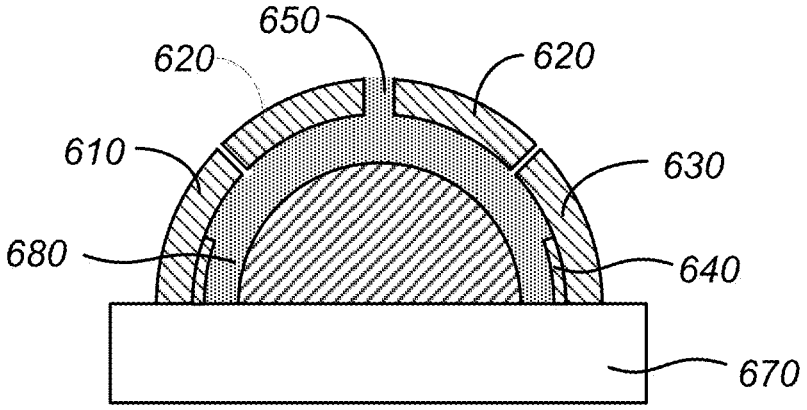
Figure 7:
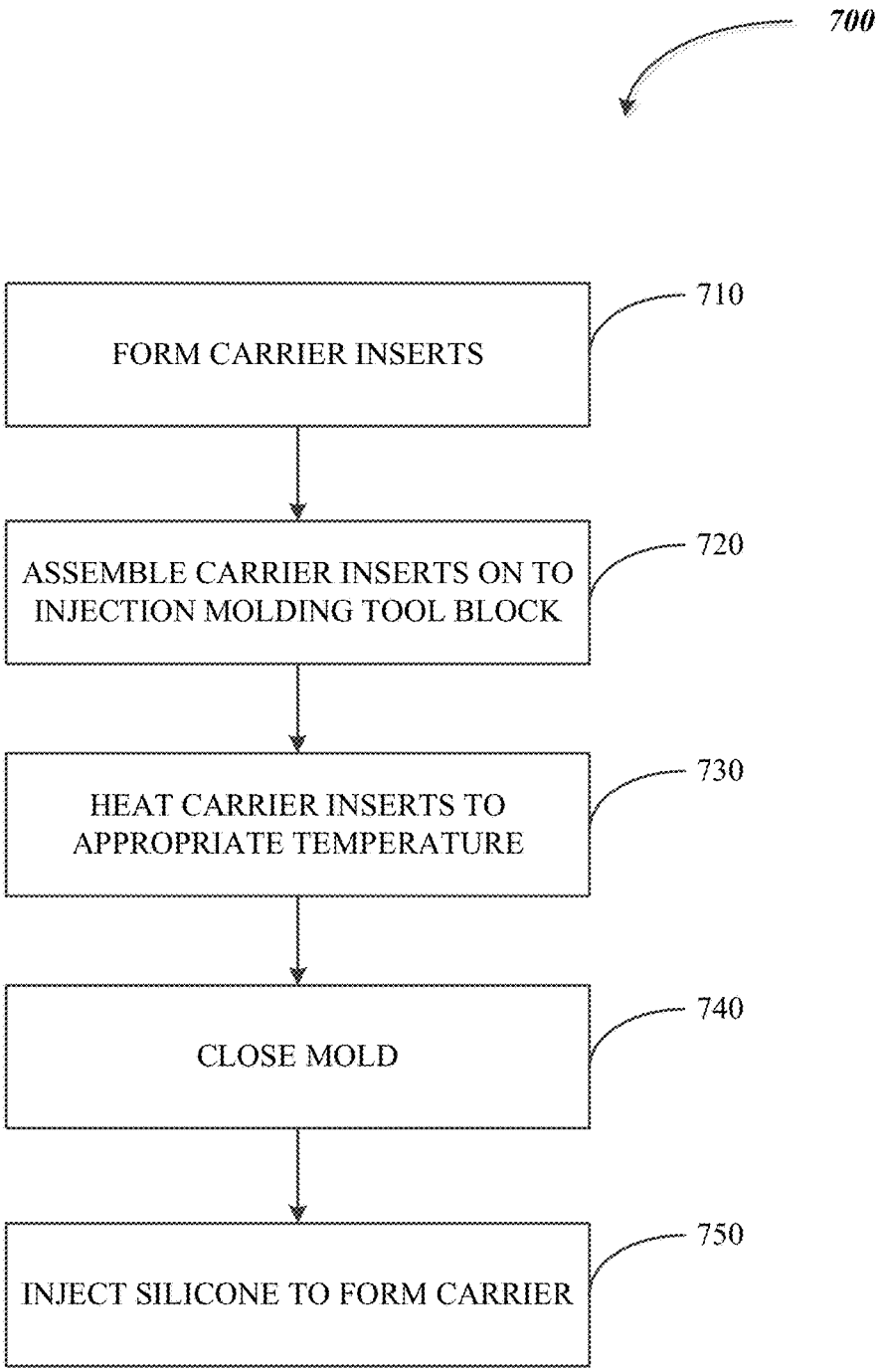
FIG. 7 is a flowchart of a method of forming a carrier of the headphone band according to some embodiments of the disclosure.

FIGS. 6A and 6B are simplified illustrations of some steps in a double shot insert molding process that can be used to form carrier 350 of headphone band 305, when the mold is open (FIG. 6A) and closed (FIG. 6B), according to embodiments. FIG. 7 is a flowchart illustrating a process 700 of making carrier 350 of the headphone band 305, according to embodiments. Process 700 of making carrier 350 is described below in conjunction with corresponding FIGS. 6A and 6B.

At step 710, process 700 includes forming carrier inserts 640 for the carrier. In examples, carrier inserts 640 can be formed by injection molding. In some embodiments, carrier inserts 640 can be made of plastic such as polyamide (PA). In some examples, carrier inserts 640 can be made of nylon. The PA can be chosen to be flexible and/or designed to withstand high temperatures when it subsequently comes in touch with liquid silicone.

At step 720, process 700 includes assembling carrier inserts 640 onto an injection molding tool block, such as illustrated in FIG. 6. Carrier inserts 640 can be placed on a tool assembly on a support surface 670. In some embodiments, the tool assembly can include three mold unit components indicated by 610, 620, and 630 on one side and a mold unit component 660 on another side. Mold unit 660 can have a substantially parabolic surface. Mold unit component 620 can have an opening 650 as shown to receive molten material through a channel. Although not shown in FIG. 6, in some embodiments, there can be more inserts placed in the mold unit components to form a complex assembly of carrier inserts.

After carrier inserts 640 are placed in tool block 630, at step 730, process 700 can include heating carrier inserts 640 to an appropriate temperature. In some embodiments, carrier inserts can be heated to a softening temperature such that they can attach well with the rest of the carrier.

At step 740, process 700 includes closing the mold as illustrated in FIG. 7B. When the mold is in a closed position, it forms mold unit cavity of the required shape of the carrier. At step 750, when liquid silicone is inserted into the mold unit cavity through opening 650, it takes the shape of the mold unit cavity 680, which can be close to the required shape of a finished carrier.

Although not shown in FIG. 7, the formed carrier with inserts can be cooled and allowed to set. Carriers formed using example process 700 can have several advantages such as being seamless on an outer cosmetic surface because of not having parting lines when formed.

Figure 8:
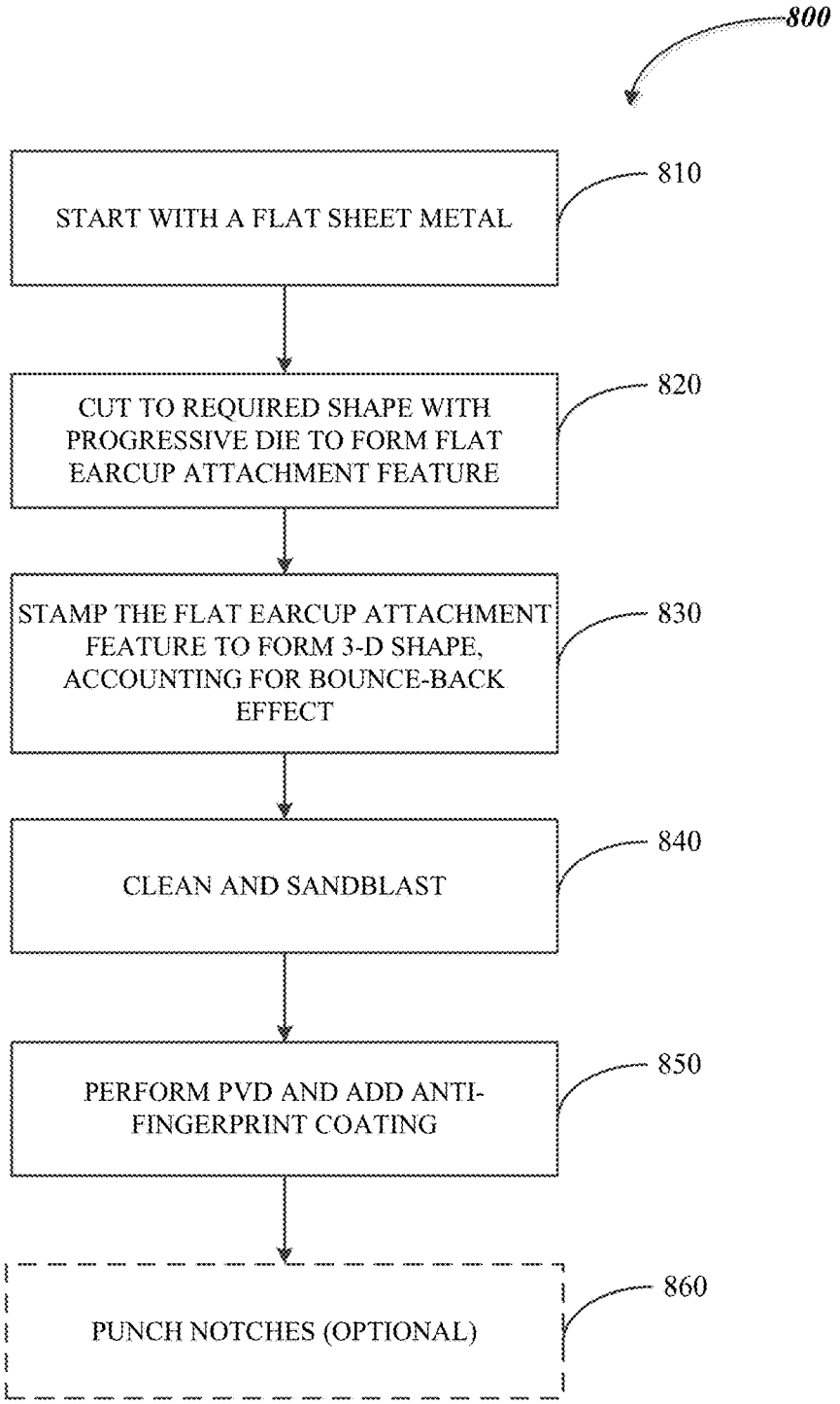
FIG. 8 is a flowchart of a method of forming the earcup connection feature according to some embodiments of the disclosure.

FIG. 8 is a flowchart illustrating a process 800 of forming a earcup connection feature, according to embodiments. At step 810, process 800 can begin with a sheet of substantially flat metal or metal alloy. In some examples, the sheet can include stainless steel. In some examples, the sheet can be lesser than 3 mm thick. At step 820, process 800 forming a flat earcup attachment feature by cutting the metal or metal alloy sheet to the required shape using a progressive die. Although not shown in FIG. 8, in some embodiments, process 800 can include bending one or more ends of the flat earcup attachment feature to form a curved shape.

At step 830, process 800 includes stamping the earcup attachment feature to form a three-dimensional shape. While stamping, appropriate levels of forces and deformation can be calculated accounting for any spring-back effects.

At step 840, process 800 includes cleaning the earcup attachment feature. In some embodiments, process 800 can include sandblasting. At step 850, process 800 includes performing a Physical Vapor Deposition (PVD) on the earcup attachment feature to deposit a layer. Such a layer can provide protection as well as enhance the cosmetic value of the earcup attachment feature.

In some embodiments, at step 860, process 800 can optionally include punching one or more protrusions into the earcup attachment feature. Although shown at step 860, it is to be noted that steps of process 800 need not be performed in order of the flow. For example, the protrusions can be punched at various points in process 800. Such protrusions can secure the earcup attachment feature in the headphones.

The foregoing description, for purposes of explanation, used specific nomenclature to provide a thorough understanding of the described embodiments. However, it will be apparent to one skilled in the art that the specific details are not required in order to practice the described embodiments. For example, while several specific embodiments of the disclosure are described above in connection with on-ear headphones, embodiments are not limited to any particular type of headphones or earphones. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A pair of headphones, comprising:

a headphone band having an outer member and an inner member cooperating to define an interior channel;

an earcup;

an earcup attachment feature having a first end coupled to the earcup and a second end having an aperture formed therethrough and disposed within the interior channel; and a brake pad mechanism extending through the aperture and compressed between the inner member and outer member, the brake pad mechanism having a first surface contacting the inner member and a second surface contacting the outer member, wherein the brake pad mechanism resists movement of the earcup attachment feature along the interior channel by generating friction between both the inner member and the first surface and the outer member and the second surface.

2. The pair of headphones of claim 1 wherein the brake pad mechanism comprises a compressible brake pad and brake pad cover.

3. The pair of headphones of claim 1 wherein a coefficient of friction between the first surface of the brake pad mechanism and the outer member is greater than a coefficient of friction between the second surface of the brake pad mechanism and the inner member.

4. The pair of headphones of claim 2 wherein the compression of the brake pad mechanism varies as the brake pad mechanism travels along the interior channel.

5. The pair of headphones of claim 2 wherein the brake pad cover includes a ridge area that defines a pocket.

6. The pair of headphones of claim 5 wherein the brake pad is positioned within the pocket.

7. The pair of headphones of claim 2 wherein the brake pad cover has a curved bottom surface.

8. The pair of headphones of claim 1 wherein the earcup attachment feature further includes a leg that extends between the first end and the second end.

9. The pair of headphones of claim 1 wherein the earcup attachment feature is a first earcup attachment feature disposed at a first end of the headphone band and the pair of headphones further comprises a second earcup attachment feature disposed at a second end of the headphone band.

10. The pair of headphones of claim 1 wherein the interior channel has a variable thickness and wherein the brake pad mechanism includes a compressible block of material that expands or contracts to maintain friction along the length of the interior channel.

11. The pair of headphones of claim 2 wherein the brake pad cover comprises polyoxymethylene (POM).

12. The pair of headphones of claim 2 wherein the compressible brake pad comprises silicone.

13. The pair of headphones of claim 1 wherein the earcup attachment feature is formed using a progressive die.

14. The pair of headphones of claim 1 wherein the earcup attachment feature comprises stamped sheet metal.

15. The pair headphones of claim 1 wherein the inner member comprises a carrier and a support structure.

16. The pair of headphones of claim 15 wherein the carrier of the inner member is formed using a double shot insert molding process.

17. The pair of headphones of claim 1 wherein the carrier of the inner member is seamless on a cosmetic surface.

18. The pair of headphones of claim 1 wherein the brake pad mechanism generates more friction with the outer member than with the inner member.

19. A pair of headphones, comprising:

a headphone band having an outer member and an inner member cooperating to define an interior channel;

a brake pad mechanism disposed between the inner member and the outer member, the brake mechanism comprising:

a first friction interface contacting the inner member; and a second friction interface contacting the outer member;

wherein the first friction interface generates friction with the inner member and the second friction interface generates friction with the outer member when the brake pad mechanism travels along the interior channel.

20. The pair of headphones of claim 19, further comprising:

an earpiece enclosing a speaker; and an earpiece attachment feature having a first end coupled to the earpiece and a second end disposed within the interior channel, wherein the brake pad mechanism is coupled to the second end of the earpiece attachment feature.

21. The pair of headphones of claim 20, wherein the first friction interface is a surface of a brake pad and the second friction interface is a surface of a brake pad cover.

* * * * *